US009506468B2

(12) United States Patent
Bratu

(10) Patent No.: US 9,506,468 B2
(45) Date of Patent: Nov. 29, 2016

(54) PROGRESSIVE CAVITY PUMP WITH UNCOUPLED NATURAL FREQUENCY

(71) Applicant: Christian Bratu, Sain Nom la Breteche (FR)

(72) Inventor: Christian Bratu, Sain Nom la Breteche (FR)

(73) Assignee: PCM TECHNOLOGIES, Levallois-Perret (FR)

( * ) Notice: Subject to any disclaimer, the term of this patent is extended or adjusted under 35 U.S.C. 154(b) by 21 days.

(21) Appl. No.: 14/403,729

(22) PCT Filed: May 28, 2013

(86) PCT No.: PCT/FR2013/051189

§ 371 (c)(1),
(2) Date: Nov. 25, 2014

(87) PCT Pub. No.: WO2013/178939

PCT Pub. Date: Dec. 5, 2013

(65) Prior Publication Data

US 2015/0139842 A1 May 21, 2015

(30) Foreign Application Priority Data

May 29, 2012 (FR) ..... 12 01519

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |
| ***F04C 2/107*** | (2006.01) |
| ***F04C 13/00*** | (2006.01) |
| ***F04C 15/00*** | (2006.01) |
| ***F04C 18/107*** | (2006.01) |
| ***F04C 29/00*** | (2006.01) |

(52) U.S. Cl.

CPC ..... *F04C 2/1075* (2013.01); *F04C 2/1071* (2013.01); *F04C 13/008* (2013.01); *F04C 15/0046* (2013.01); *F04C 18/1075* (2013.01); *F04C 29/0028* (2013.01); *F04C 2240/10* (2013.01); *F05C 2251/02* (2013.01)

(58) Field of Classification Search

CPC .. F04C 2/1071; F04C 2/1073; F04C 2/1075; F04C 18/1075; F04C 5/00; F04C 13/008; F04C 2240/10; F04C 29/0028; F04C 15/0046; F05C 2251/02

USPC ..... 418/48, 150, 152–153, 178–179

See application file for complete search history.

(56) References Cited

U.S. PATENT DOCUMENTS

| | | | | |
|---|---|---|---|---|
| 3,139,035 A | | 6/1964 | O'Connor | |
| 3,912,426 A | * | 10/1975 | Tschirky | F04C 2/1075 418/48 |
| 5,221,197 A | * | 6/1993 | Kochnev | F01C 1/101 418/48 |
| 5,318,416 A | * | 6/1994 | Hantschk | F04C 2/1075 418/48 |
| 6,170,572 B1 | * | 1/2001 | Fulbright | F04C 2/1075 418/48 |
| 2006/0153724 A1 | * | 7/2006 | Delpassand | F04C 2/1075 418/48 |

FOREIGN PATENT DOCUMENTS

| | | |
|---|---|---|
| EP | 0220318 A1 | 5/1987 |
| WO | 2008091262 A1 | 7/2008 |

OTHER PUBLICATIONS

European Patent Office (EPO), International Search Report issued in corresponding PCT Application No. PCT/FR2013/051189, Jul. 29, 2013.

* cited by examiner

*Primary Examiner* — Theresa Trieu

(74) *Attorney, Agent, or Firm* — Patzik, Frank & Samotny Ltd.

(57) ABSTRACT

A progressive cavity pump comprising a casing, a helical stator including a helical cylinder and a helical rotor capable of rotating inside said helical cylinder. The helical stator also comprises at least one compensator arranged in said casing, between the casing and said helical cylinder; said helical cylinder and said compensator being deformable in a direction perpendicular to the longitudinal axis of the casing.

13 Claims, 6 Drawing Sheets

PROGRESSIVE CAVITY PUMP WITH UNCOUPLED NATURAL FREQUENCY

FIELD OF THE INVENTION

The present invention relates to an architecture for progressive cavity-type volumetric pumps allowing a significant increase in pump reliability and performance.

BACKGROUND OF THE INVENTION

The progressive cavity pump—also referred to hereinafter by the abbreviation PCP—was invented by Rene Moineau in 1930 and current industrial PCPs correspond to the basic principles.

To describe the architecture of the PCP according to the invention, we begin by showing the operation of the conventional PCP while emphasizing the processes that affect the reliability and performance of this pump.

We then present the PCP according to the invention, as well as its operation and its ability to improve reliability and performance.

The architecture of the conventional PCP includes a metal helical rotor inside a helical stator that is elastic (of elastomer) or rigid (metal, of composite materials).

FIG. 2A shows a longitudinal cross-section of a conventional PCP with an elastic helical stator, according to the prior art. FIG. 2B shows an enlarged view of the boxed area B indicated in FIG. 2A.

As can be seen in FIGS. 2A and 2B, the conventional PCP 1 with elastic stator consists of a metal helical rotor 2 rotating within a helical stator 3, usually of elastomer, contained in a casing 5. The geometry of the PCP results in a set of isolated cavities 4 of constant volume, defined between the rotor 2 and the stator 3, which the rotor 2 displaces from the intake or inlet (low pressure) toward the discharge or outlet (high pressure).

In this sense, the PCP is a positive displacement pump capable of transporting various products: more or less viscous liquids, multiphase mixtures (liquid, gas, solid particles).

The stator 3, of elastomer, has radial thickness H1 in its concave portions and radial thickness H2 in its convex portions. For example, the stator 3 having an outer diameter of 7 cm has thicknesses of 2.5 for H1 and 1.5 for H2.

To ensure that the PCP 1 compresses the fluids (liquids and gases) with a virtually fluidtight seal between the cavities 4, the rotor 2 with its helical rotation exerts a compressive force on the elastomer of the stator 3. Given the risk of damage to the stator 3, the reliability of PCPs is a major issue in the industrial application of these pumps.

For example, the oil industry uses PCPs in deep wells to pump mixtures of oil, water, and gas, that are carrying solid particles. In the pumping conditions downhole, the elastomer of the stator 3, subjected to complex thermal, chemical, and mechanical processes (dynamic forces and pressure), expands and thus increases the forces exerted by the rotor 2 on the stator 3.

The service life of conventional PCPs is therefore considerably reduced.

Using the diagrams in FIGS. 2A and 2B, we can describe the behavior of the stator 3 of the conventional PCP subjected to the forces exerted by the rotor 2 in its helical motion.

The operation of the conventional PCP 1 includes close contact, by the interference fit between the rotor 2 and the elastomeric stator 3, which ensures two combined functions:

- providing the relative fluidtightness necessary for pumping the cavities 4, from intake (low pressure) to discharge (high pressure),
- concentrating and transmitting forces through the stator 3 to the casing 5.

Thus, to minimize leakage between the cavities 4, the rotor 2 exerts compressive force P1 on the stator 3, which deforms by a height h1, generally called the interference, along an interference length L1. In the case mentioned above, this length L1 is about 4 cm.

As a result, the interference h1 between the rotor 2 and the stator 3 provides virtually fluidtight cavities 4, thus limiting leakage.

At the same time, the helical motion of the rotor 2 generates a shear force Q1 on the stator 3. The greater the interference h1, the greater the compressive forces P1 and shear forces Q1, and the greater the risk of damage to the stator 3.

In practice, an initial interference h1 between the rotor 2 and the stator 3 is adopted; this is the result of a compromise between acceptable stresses and a relative fluidtightness to limit leaks. For example, for the abovementioned stator 3 having an outside diameter of 7 cm, an initial interference h1 of 0.5 mm is adopted.

However, in the downhole conditions of an oil well, the stator 3 undergoes changes leading to an increase in the thicknesses H1 and H2 of the stator 3 and in the interference h1 between the rotor 2 and the stator 3.

Several phenomena can lead to the increase in the thicknesses H1 and H2 of the stator 3 and in the interference h1.

- First, thermodynamic processes lead to expansion of the stator 3. In particular:
  - the petroleum products downhole often have high temperatures,
  - gas compression in the PCP causes the temperature to rise, particularly in the portion near the pump outlet (high pressure),
  - the friction between the rotor 2 and the stator 3 also leads to an increase in temperature,
  - the large thickness H1 of the stator 3 limits the dissipation of heat to the outside, further contributing to the expansion of the stator 3.
- The chemical reaction of the elastomer of the stator 3 with the pumped fluids (liquids and gases) often causes the stator 3 to swell.
- Due to pressure in the pump, the presence of gas leads to swelling of the stator 3; in effect, the pressurized gas penetrates the elastomer and acts on the stator 3 during pressure variations in the pump.
- Lastly, the helical motion and vibrations of the rotor 2 generate dynamic forces on the stator 3 as a function of the interference h1 among other factors.

Under these conditions, the interference h1 is the determining factor in the balance between fluidtightness and the contact forces between the rotor 2 and stator 3.

Analysis of the impact of the interference h1 on the compressive P1 and shear Q1 forces shows the risk of damage to the stator 3.

For this, we adopt the following notation:

E, the elastic modulus of the elastomer (the stator 3)

R, the radius of the rotor 2 (FIG. 2A)

C, the constants

V, the rotational speed of the rotor 2 (revolutions/minute).

In general, the functions f(V) are used to indicate the influence of the rotational speed V of the rotor 2 on the compressive P1 and shear Q1 forces, and on the interference h1 between the rotor 2 and stator 3.

The analytical formulation thus demonstrates the correlation between the interference h1 and the compressive P1 and shear Q1 forces; to facilitate interpretation, the other parameters are grouped together.

As can be seen in FIG. 2B, the compressive force P1 applied by the rotor 2 results in the interference h1 with the stator 3.

The viscoelastic model (Bowden) yields expressions (1, 2), linking the compressive force P1 and interference h1:

$$P1=C1.f1(V).h1^{3/2}.E.R^{1/2} \quad (1)$$

$$h1=C2.f2(V).(P1/E)^{2/3}.R^{-1/3} \quad (2)$$

Linear approximation (elastic model, Boussinesq) facilitates the interpretation (expressions 3, 4):

$$P1=C3.f3(V).h1.R.E \quad (3)$$

$$h1=C4.f4(V).P1/(R.E) \quad (4)$$

These relations (1,2,3,4) show that the compressive forces P1 are significant when the interference h1 is large. In addition, these forces are concentrated within a volume in the immediate vicinity of the contact surface S1 (FIG. 2B).

Therefore, the swelling of the stator 3 increases interference h1 and leads to significant compressive forces P1 concentrated at the contact surfaces S1. These contact surfaces S1, shown in FIGS. 2A and 2B, are surfaces of the inner face of the elastomer of the stator 3, positioned opposite a convex portion of the rotor 2.

Relations (3,4) describe the elastic compression (Boussinesq) of the stator 3 as a result of compressive forces P1. If we denote the stiffness of the elastomeric stator as Ks, we find that the behavior of the stator 3 is equivalent to the response of an elastic spring at constant rotor speed V:

$$P1=Ks.h1 h1=P1/Ks \; Ks=C3.E.R \quad (5)$$

The helical motion of the rotor 2 generates a shear force Q1 which also depends on the interference h1 (FIG. 2B). The elastoplastic approach (Hill) leads to the relation:

$$Q1=C5.f5(V).h1(1-h1/H1).E.R \quad (6)$$

The shear forces Q1 exerted on the stator 3 are a function of the interference h1, Q1=F(h1); the greater the interference h1, the greater the risk of damaging the stator. However, as previously mentioned, conventional PCPs 1 must have an initial interference h1 of around 0.5 mm to ensure fluidtight cavities 4. Given the production conditions in oil wells (thermodynamic-chemical-dynamic), the stator undergoes an increase in thicknesses H1 and H2 of about 5 to 10%, and, depending on the properties of the elastomer, the interference increases by about 1 mm which means that it is multiplied by 2. Under these conditions, the compressive P1 and shear Q1 forces are also multiplied by 2. As for the dynamic forces exerted by the helical rotation of the rotor 2 on the stator 3, these depend on the rotational speed V of the pump; in order to produce (flows and pressures) under cost-effective conditions, PCPs rotate at the speed of 200-500 rpm. Given the pumping conditions in the well, the service life of an elastomeric stator 3 is significantly reduced; experience shows that the average is one year, but damaged stators have been observed after 1-3 months of operation.

The vibrations of the rotor 2 depend on the natural frequency of the rotor 2 and on the rotational speed of the pump and can be very significant, especially in the resonance between the rotor 2 and the rotational speed (frequency). The amplitude of the vibrations of the rotor 2, perpendicular to the axis X-X, creates increased interference h1, and therefore the compressive P1 and shear Q1 forces exerted on the stator 3 are also increased.

Thus, the operation of conventional PCPs 1 focuses the forces at the contact between the rotor 2 and stator 3, and often leads to degradation of the stator 3. In practice, the oil company must remove the damaged pump from the well and replace it; this is a long process, during which the well is no longer in production and therefore there is a significant economic impact.

The more recent PCP 24 which includes a rigid helical stator (metal, composite materials) is shown in longitudinal section in FIG. 6. This pump 7 comprises a helical rotor which rotates inside the rigid helical stator 25; there is some clearance 26 between the rotor 7 and the stator 25.

In practice, the stator 25 made of a rigid material (metal, composite materials) is mounted inside the casing 19; then, the helical rotor 7 is inserted inside the rigid stator 25, with some clearance 26. The architecture of this PCP is similar to that of a conventional PCP: the difference lies in the fact that there is clearance 26 between the rotor 7 and the rigid stator 25.

This PCP 24 is used in particular for pumping viscous liquids (heavy oils); the rotor 7 carries the viscous liquid and a liquid film is formed in the clearance 26 between the rotor 7 and the rigid stator 25. Depending on the manufacturing method, this clearance is less than 1 mm.

As a result, with no contact between the rotor 7 and the stator 25, the PCP 24 pumps the viscous liquids (heavy oils).

Given the existence of this clearance 26, the rotation of the helical rotor 7 at speeds of 200-500 rpm generates vibrations (resonance, unstable vibrations) and shocks between the rotor 7 and the stator 25.

For example, if the natural frequencies of the rotor 7 and/or the rigid stator 25 are of the same order of magnitude as that of the rotational speed (speed of 200-500 revolutions per minute), the forces due to vibrations and shocks are multiplied by 6-8; the rotor 7 and the stator 25 cannot resist these forces for very long.

The dynamic response of the PCP 24 with rigid stator 25 can damage the rotor 7 and/or stator 25. In these circumstances, the oil company must replace the pump, which is a major operation with significant economic impact.

SUMMARY OF THE INVENTION

The object of the present invention is to provide a more reliable PCP having a longer service life, in order to reduce production costs. To this end, the present invention aims to provide a new architecture for progressive cavity pumps (PCP) which significantly increases pump reliability and performance.

For these purposes, the invention proposes a progressive cavity pump comprising:

- a cylindrical casing having a longitudinal axis; said casing being provided with an inlet opening at one end and with an outlet opening at its opposite end,
- a helical stator contained within said casing; said helical stator comprising a helical cylinder having a central axis coinciding with the longitudinal axis of said casing;
- a helical rotor suitable for rotating inside said helical cylinder so as to move a fluid from the inlet opening toward the outlet opening, characterized in that said helical stator further comprises at least one compensator arranged within said casing, between the casing and said helical cylinder; said helical cylinder and said compensator being adapted to deform in a direction perpendicular to said longitudinal axis.

Thus, said compensators have open or closed deformable profiles for which the shape, dimensions, and materials used provide the necessary elasticity to compensate for deformations of said helical stator.

In some embodiments which are in no way limitative:

said helical stator comprises an elastic layer fixed to an inner face of said helical cylinder.

said elastic layer has a thickness of between 0.5 cm and 2 cm, in particular from 0.5 to 1.5 centimeters.

said helical rotor is adapted to rotate at a frequency of rotation, and said at least one compensator is able to decouple the natural frequencies of the helical rotor and helical stator assembly from the frequency of rotation of the helical rotor.

said at least one compensator is defined by a coefficient of stiffness (K) which satisfies the following relation:

$$Ko \leq (1/9).M.W^2$$

where:

W is the frequency of rotation of the helical rotor,

M is the total mass of the helical rotor and helical stator.

said at least one compensator has a closed profile.

the cross-section of said at least one compensator has an elliptical cross-section.

said at least one compensator has an open profile.

said at least one compensator is arranged on a concave portion of said helical cylinder.

said at least one compensator is arranged on a convex portion of said helical cylinder.

said helical stator comprises a plurality of compensators evenly distributed along the casing.

said helical stator comprises a single compensator that is helical in shape, arranged around said helical cylinder.

said compensators are made of a metal or a composite material.

The invention also relates to the application of a pump as mentioned above for pumping fluids, said fluids being liquids, viscous liquids, or gases, and for pumping multiphase mixtures of liquids and gases with solid particles.

BRIEF DESCRIPTION OF THE DRAWINGS

The invention will be better understood by reading the following description, given purely by way of example and without limitation, with reference to the drawings in which.

DETAILED DESCRIPTION OF THE INVENTION

Figure 1A:
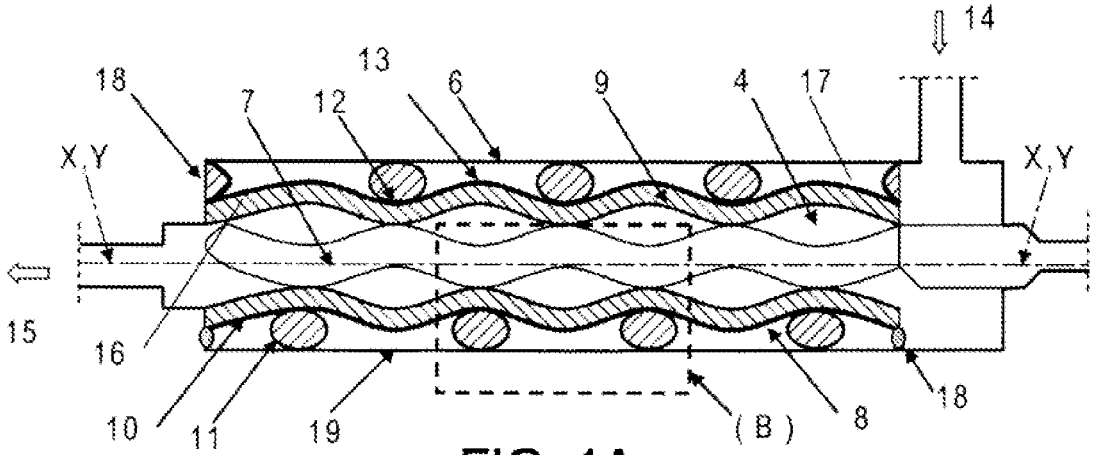
FIG. 1A is an axial cross-section of the PCP pump 6 according to a first embodiment of the invention.
Figure 1B:
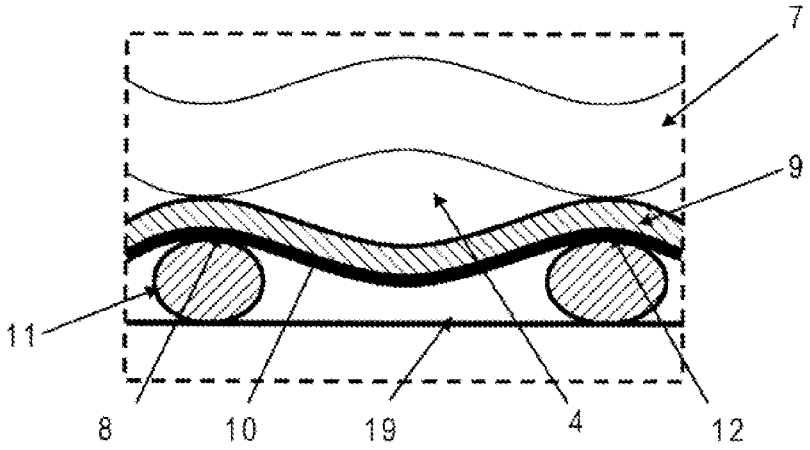
FIG. 1B is an enlarged view of the boxed area B indicated in FIG. 1A.

The PCP pump 6 according to a first embodiment of the invention, illustrated in FIGS. 1A and 1B, comprises a cylindrical casing 19 with longitudinal axis X-X, a helical stator 8 contained in the casing 19, and a helical rotor 7 able to rotate within the helical stator 8.

The casing 19 is provided with an inlet opening 14 at one of its ends and with an outlet opening 15 at its opposite end.

The helical rotor 7 is adapted to rotate inside the helical stator 8 at a predetermined speed hereinafter called the rotational speed, in order to move a fluid from the inlet opening 14 towards the outlet opening 15.

The helical stator 8 comprises a thin elastic layer 9, generally of elastomer, a helical cylinder 10 having a central axis Y-Y coinciding with the longitudinal axis X-X of the casing 19, and compensators 11 able to deform in order to compensate for variations in the radial dimensions of the helical cylinder 10.

The helical cylinder 10 is generally made of metal or composite materials. It is suitable for transmitting to the compensators 11 the forces exerted by the rotor 7 on the elastic layer 9.

The helical cylinder 10 has a face 17 facing the casing 19, hereinafter referred to as the outer face 17, and a face 16 facing the rotor 7, hereinafter referred to as the inner face 16.

The helical cylinder 10 successively shrinks and grows in diameter along its length, forming on the outer face 17 and inner face 16 of the helical cylinder 10 a succession of concave portions 12 alternating with convex portions 13.

The elastic layer 9 has a constant thickness of between 0.5 and 2 centimeters, and preferably between 0.5 cm and 1.5 cm.

The elastic layer 9 is attached to the inner face 16 of the helical cylinder 10. The attachment may be achieved by adhesion, gluing, or by a hot working method and/or by mechanical attachment devices.

The compensators 11 are elastic and have deformable profiles. The compensators 11 are adapted to deform in a direction perpendicular to said longitudinal axis (X-X), on the one hand to compensate for expansion of the elastic layer 9 and on the other hand to reduce vibrations exerted by the helical rotor 7 on the elastic layer 9, when the helical rotor 7 rotates within the helical stator 8.

When the compensators 11 compensate for expansion of the elastic layer 9, the dimensions of the compensators 11 decrease in a direction perpendicular to said longitudinal axis (X-X) to compensate for the expansion of the elastic layer 9, the helical cylinder 10, and the helical rotor 7 during the entire period during which the pump is subjected to thermal, chemical, and pressure conditions causing this expansion.

When the compensators 11 are reducing the vibrations exerted by the helical rotor 7 on the elastic layer 9, the dimensions of the compensators 11 will successively shrink and expand in a direction perpendicular to said longitudinal axis (X-X) at a frequency equal to the frequency of rotation of the helical rotor 7, to compensate for the vibrations of the rotor 7.

According to the first embodiment of the invention, the compensators 11 are elastic and have closed profiles. For example, the compensators 11 are in the shape of an aluminum shell filled with air.

Alternatively, the compensators 11 consist of an aluminum shell containing rubber.

According to another embodiment, the compensators 11 are shells made of composite materials.

The compensators 11 are arranged within the casing 19 between the helical cylinder 10 and the casing 19. In particular, according to the first embodiment of the invention illustrated in FIGS. 1A and 1B, the compensators 11 are attached to the inner wall of the casing 19 and to the concave portions 12 of the helical cylinder 10.

Advantageously, ring-shaped compensators 18 surrounding the helical cylinder 10 are also attached between each end of the helical cylinder 10 and each end of the casing 19.

The compensators 11,18 are attached to the casing 19 and to the helical cylinder 10, for example by fasteners or by welding.

The dimensions, shape, geometry, and thickness of the compensators 11 and the component materials of the compensators 11 are selected so as to:

- compensate for expansion of the elastic layer 9 (elastomer), the rotor 7, and the helical cylinder 10,
- reduce the vibrations generated by the coupling between the frequency of rotation of the helical rotor 7 and the natural frequency of the helical stator 8-rotor 7 assembly.

For example, a compensator 11 having a cross-section that is elliptical in shape, with axes of 1.2 cm and 4 cm, made of an aluminum plate 2 mm thick, ensures a 70% reduction of the forces exerted by the rotor 7 on the elastic layer 9. Such a compensator 11 having an elliptical cross-section can be used in a casing 19 having an inner diameter measuring 7 cm (mentioned above).

In this casing 19, the thickness of the elastomeric elastic layer 9 can for example measure 1.5 cm and the helical cylinder 10 can be made of a metal plate having a thickness of about 2 mm.

Therefore, the compensators 11 arranged in accordance with the invention give the pump the ability to deal with the thermodynamic-chemical-dynamic conditions of pump operation, thus improving the reliability and performance of the PCP 6.

Figure 2C:
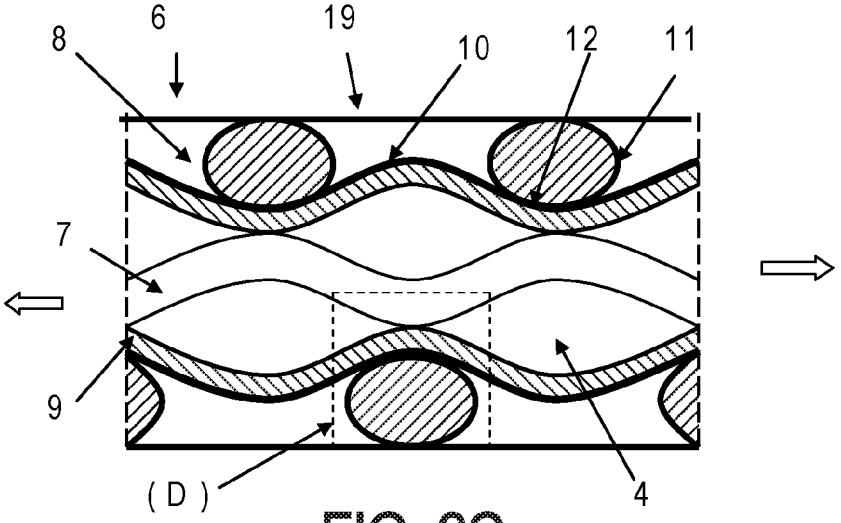
FIG. 2C is an axial cross-section of a portion of the pump shown in FIG. 1.
Figure 2A:
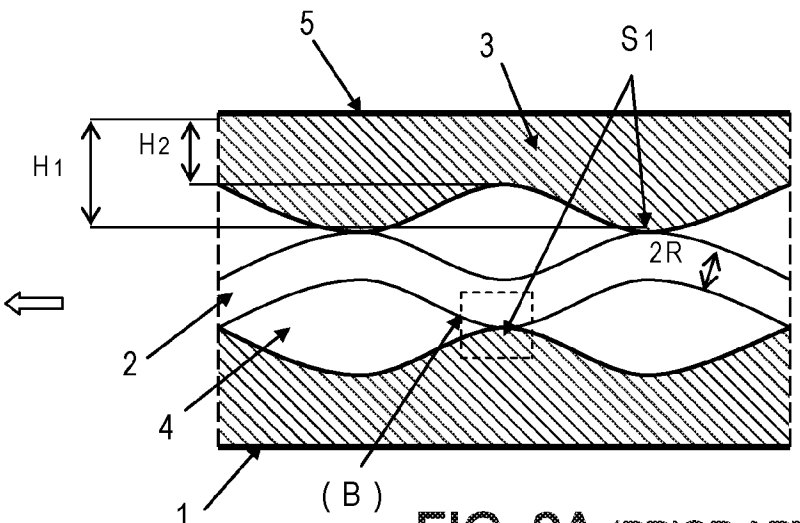
FIG. 2A (PRIOR ART)
FIG. 2A is an axial cross-section of a pump having an elastomeric stator in a conventional PCP 1 known from the prior art.
Figure 2B:
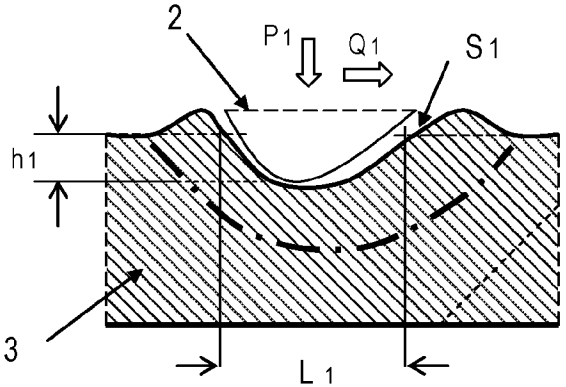
FIG. 2B (PRIOR ART)
FIG. 2B is an enlarged view of the boxed area B indicated in FIG. 2A.
Figure 2D:
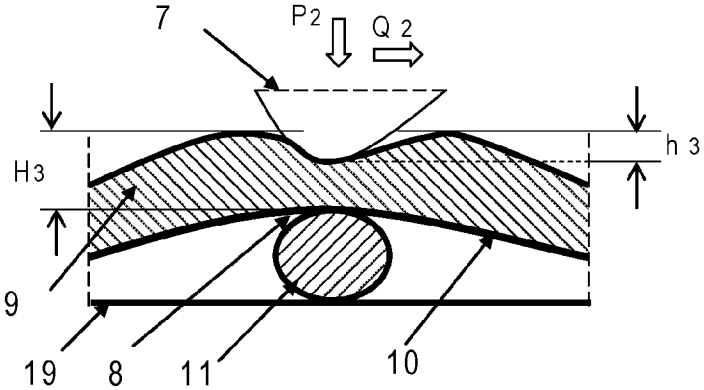
FIG. 2D is an enlarged view of the boxed area D indicated in FIG. 2C.

To evaluate the efficiency of the compensators 11, the PCP 6 of the invention shown in FIGS. 2C and 2D is compared with the conventional PCP 1 shown in FIGS. 2A and 2B.

As can be seen in FIGS. 2A and 2B, the elastomeric stator 3 of the conventional PCP 1 is subject to the thermodynamic-chemical-dynamic processes which cause the swelling of the large thickness H1 and the increase in interference h1.

This process thus results in the significant compressive P1 and shear Q1 forces exerted on the contact surface S1 between the helical rotor 2 and the helical stator 3. This leads to the risk of damage to the elastomeric helical stator 3.

As can be seen in FIGS. 2C and 2D, the PCP 6 according to the invention comprises:

- the elastic layer 9 with its small thickness H3, for example around 1.5 cm, generally of elastomer,
- an interference between the helical rotor 7 and the elastic layer 9, referred to below as h3,
- the helical cylinder 10 to which the elastic layer 9 is fixed.

This helical cylinder 10 transmits the forces exerted on the elastic layer 9 to the compensators 11. The compensators 11 are able to compensate for the deformation of the elastic layer 9 and thereby reduce the interference h3 and the compressive P2 and shear Q2 forces. The compensators 11 transmit the forces to the casing 19.

At the same time, the compensators 11 help to reduce the dynamic forces generated by vibrations of the rotor 7 on the elastic layer 9. The vibrational properties of the compensators 11 depend on their shape, their dimensions, and the materials used. By choosing a specific form or using a certain material for the compensators 11, the natural frequencies of the rotor 7-helical stator 8 assembly are controlled, avoiding the resonance and instability of the dynamic response. Under these conditions, the compensators 11 reduce the vibrational components of the compressive P2 and shear Q2 forces.

Thus, the compensators 11 are capable of decoupling the natural frequencies of the helical rotor 7 and helical stator 8 assembly from the frequency of rotation of the helical rotor 7.

For example, it is common to observe in an oil field that the rotor 2 of the conventional PCP 1 has instabilities when rotating at 300 rpm. To avoid the degradation of the conventional PCP 1 caused by these instabilities, the oil company must reduce the rotational speed of the rotor 2 to 150 rpm, which decreases production.

With compensators 11, the PCP 6 stabilizes the vibratory response of the rotor 7 which bolsters its production capacity to 300 rpm, thus satisfying economical production conditions.

It follows that the operation of the PCP according to the invention reduces the compressive P2 and shear Q2 forces, thereby improving the reliability of the PCP 6.

Figure 3B:
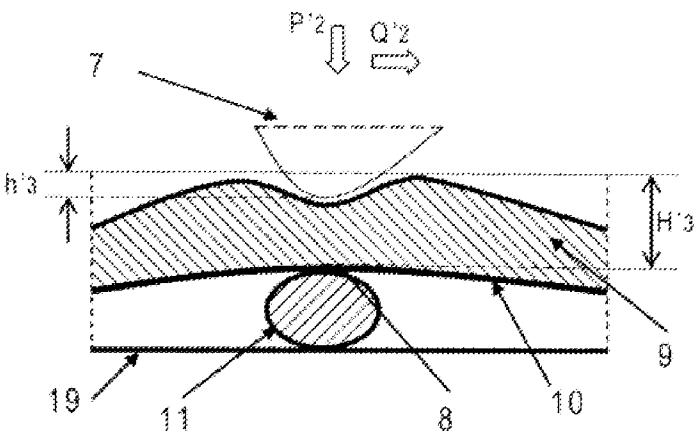
FIG. 3B is a view identical to the view shown in FIG. 3A but after the pump is placed in service, resulting in increased interference h'3>h3, and a diagram showing a spring system equivalent to said elastic layer 9-compensator 11 assembly.
Figure 3B:
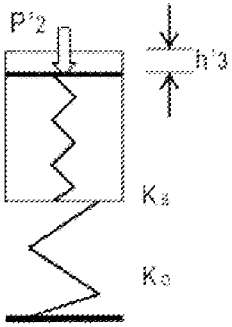
Figure 3A:
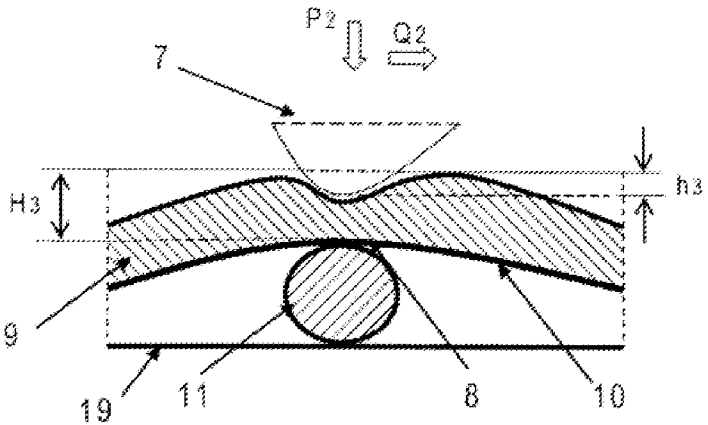
FIG. 3A is a view similar to the view shown in FIG. 2D for a PCP 6 (shown in FIGS. 1A and 1B) having an initial interference h3 between the rotor 7 and the elastic layer 9, before the pump is placed in service, and a diagram representing a spring system equivalent to said elastic layer 9 compensator 11 assembly.
Figure 3A:
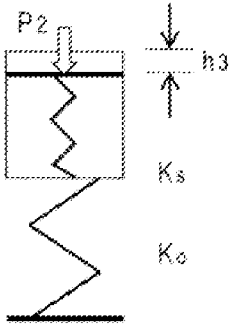

As can be seen in FIG. 3A, prior to placing the pump in service, the elastic layer 9 of the PCP 6 has thickness H3 and interference h3 with the helical rotor 7. The equivalent mechanical system of the elastic layer 9-compensators 11 assembly consists of two springs of different stiffnesses. Ks is the equivalent stiffness of the elastic layer 9, and Ko is the stiffness of the compensator 11.

After the pump is placed in service, the thermal-chemical-dynamic process causes swelling of the elastic layer 9, where the thickness becomes H'3>H3, resulting in increased interference h'3>h3.

As can be seen in FIG. 3B, after the pump is placed in service, the dimension of the compensator in a direction perpendicular to the axis X-X is reduced to compensate for the increased interference.

As a result, the compensators 11 are sized to compensate for the swelling of the elastic layer 9 and to reduce the forces acting on the elastic layer 9. Their dimensions are chosen so as to maintain the initial interference, meaning h'3≈h3. When this interference h'3 is kept substantially constant, the contact forces of the helical rotor 7-elastic layer 9 assembly are maintained at the required level.

To achieve this, we must characterize the elasticity of the assembly of elastic layer 9-helical cylinder 10-compensators 11.

The formula (5) for the response of the elastomeric stator leads to the equivalent stiffness Ks (FIGS. 3A and 3B):

$$h3=P2/Ks\ Ks=C3.E.R \tag{7}$$

$$h'3=P'2/Ks$$

The deformation Xo of the compensator 11 due to the effect of the compressive force P2 reveals the stiffness of the structure Ko:

$$P2=Ko.Xo\ Ko=C7.Eo.I/r^3 \tag{8}$$

where Eo and I are the elastic modulus and the moment of inertia of the compensator 11, and r is the characteristic radius of the compensator 11. For example, in the case of the compensator 11 that is elliptical in shape, the characteristic radius r is the mean of the radii of the ellipse.

As mentioned, after the pump is placed in service (FIG. 3B), the thermodynamic-chemical-dynamic process causes swelling of the elastic layer 9 which results in a change Δh in the interference:

$$h'3=h3+\Delta h \tag{9}$$

The compensators 11 of the invention are preferably chosen such that the swelling of the elastic layer 9 is compensated for by the compression ΔXo of each compensator 11:

$$P'2=Ko.(Xo+\Delta Xo) \tag{10}$$

which means that Δh is minimal if h'3≈h3:

$$\Delta h = \Delta Xo.\ (Ko/Ks);\quad Ko/Ks\Big|_{min} \longrightarrow \Delta h\ min \tag{11}$$

and thus the initial interference h3 is kept substantially unchanged despite the swelling of the elastic layer 9.

The compensators 11 compensate for deformations of the elastic layer 9, and the forces exerted on the elastomer of the elastic layer 9 remain at the initial level.

Also, controlling the stiffness Ko of the compensators 11 facilitates controlling the dynamic response (particularly the natural frequencies), and thus prevents resonance with the vibrations of the rotor 7.

To this end, the compensators 11 according to the invention have a stiffness coefficient Ko which satisfies the following relation:

$$Ko\leq(1/6).M.W^2 \tag{12}$$

where:

W is the frequency of rotation of the helical rotor 7,

M is the total mass of the helical rotor 7 and of the helical stator 8.

At the same time, the choice of stiffness Ko of the compensators 11 provides control of the compressive and shear forces and of the vibrations.

Given the thermodynamic-chemical-dynamic conditions (vibrations), optimization of the compensators 11 keeps the forces exerted by the helical rotor 7 on the elastic layer 9 within the required reliability limits.

As mentioned, the conventional PCP 1 with elastomeric stator 3 focuses two functions on the contact surface S1 between the rotor 2 and stator 3: the relative fluidtightness and the high contact forces (compressive P1 and shear Q1 forces).

The PCP 6 according to the invention dissociates these two functions:

- the fluidtightness is maintained at the contact between helical rotor 7-elastic layer 9,
- the forces are passed on to the compensators 11 and transmitted to the casing 19.

The operation of the PCP 6 according to the invention results in reduced forces exerted on the elastic layer 9 and improves pump reliability.

Figure 4:
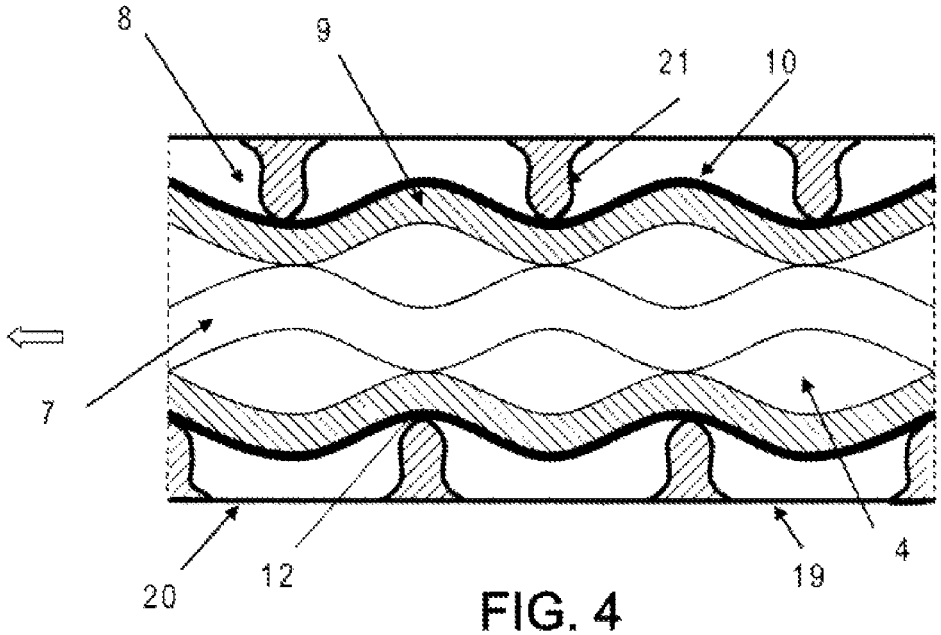
FIG. 4 is an axial cross-section of a portion of a PCP according to a second embodiment of the invention.

FIG. 4 shows an axial cross-section of a PCP 20 according to a second embodiment of the invention.

Elements that are identical or similar to the first embodiment of the invention (FIGS. 1A and 1B) are shown with the same references in FIG. 4 and will not be described again.

According to this alternative embodiment, the compensators 21 have elastic open profiles (of metal or composite material), each placed between a concave portion 12 of the helical cylinder 10 and the casing 19.

The open compensators 21 are able to compensate for deformations of the elastic layer 9 and to transmit forces to the casing 19.

For example, for the PCP having a 7 cm outside diameter, the compensators 21 are aluminum and shaped like an inverted U that is 1.2 cm in height and 3 cm in width, with a thickness of about 2 mm.

For example, said compensators 21 are shaped like a hollow pin having a tip and a broad base; said tip being arranged against said helical cylinder 10; said broad base being fixed against the inner face of said casing 19.

Figure 5:
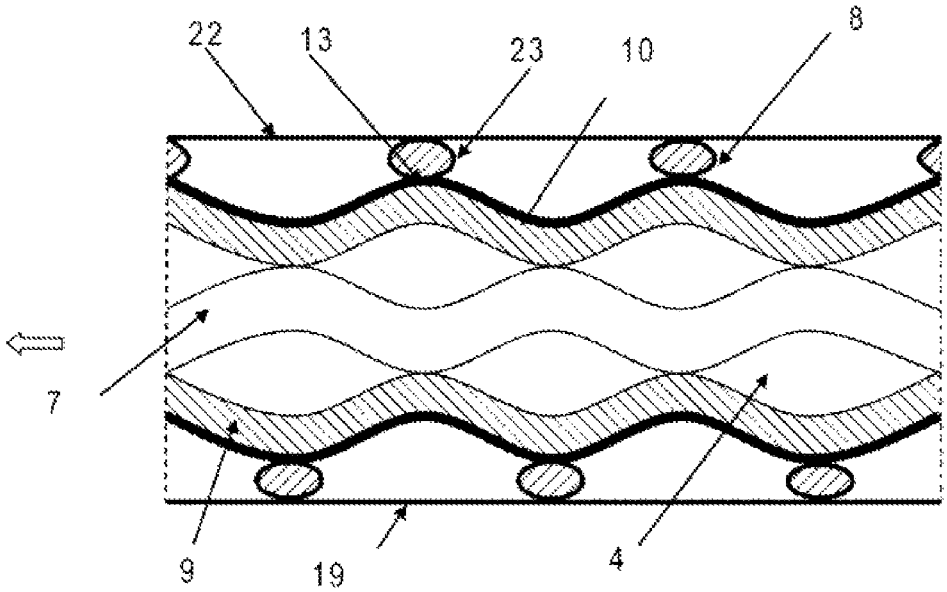
FIG. 5 is an axial cross-section of a portion of a PCP according to a third embodiment of the invention.

A PCP 22 according to the third embodiment of the invention is illustrated in FIG. 5.

Elements that are identical or similar to the first embodiment of the invention (FIGS. 1A and 1B) are shown with the same references in FIG. 4 and will not be described again.

In particular, this PCP 22 comprises a helical rotor 7 rotating within the helical stator 8, the elements of which are:

- the elastic layer 9 is fixed to the helical cylinder 10,
- the compensators 23 are enclosed elastic shells that have substantially elliptical profiles and are made of metal or composite material. They are arranged between the convex portion 13 of the helical cylinder 10 and the casing 19. The compensators 23 according to this embodiment of the invention are similar to the compensators 11 in the first embodiment of the invention but have a dimension along an axis perpendicular to the longitudinal axis (X-X) of the casing 19 that is smaller than the dimension of the compensators 11 according to the first embodiment of the invention along the same axis. They are therefore flatter than those compensators 11.

The compensators 23 are able to compensate for deformations of the elastic layer 9 and to transmit forces to the casing 19. For example, for a PCP 22 having an outer diameter of 7 cm, the compensators 23 are aluminum and have flat elliptical profiles, with axes of 1 cm and 2 cm and a thickness of about 1-2 mm.

Figure 7:
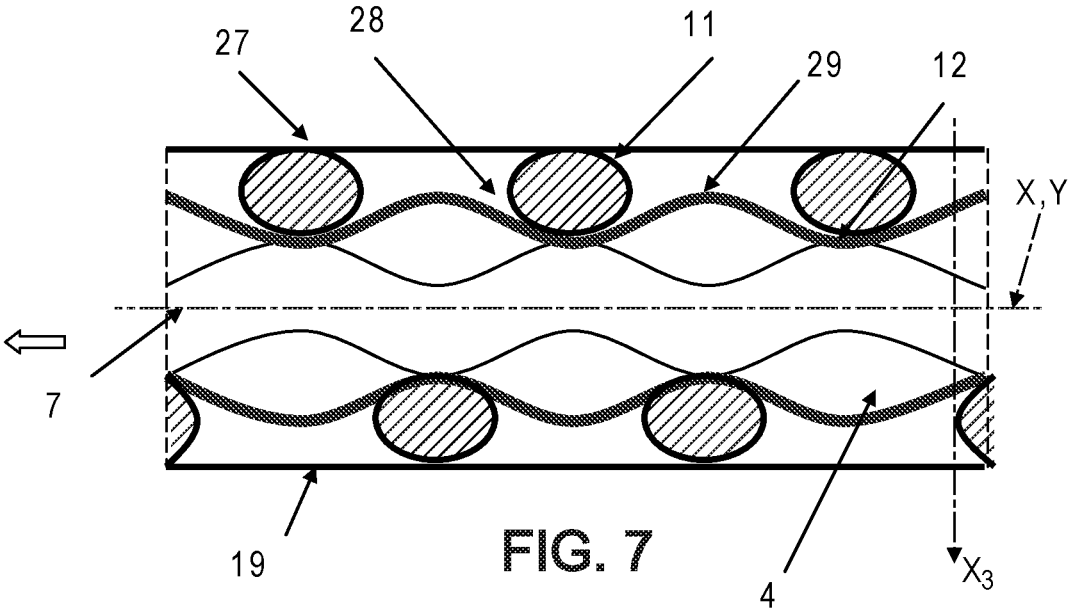
FIG. 7 is an axial cross-section of a portion of a PCP according to a fourth embodiment of the invention.

The PCP 27 according to the fourth embodiment of the invention is illustrated in FIG. 7.

Elements that are identical or similar to the first embodiment of the invention (FIGS. 1A and 1B) are shown with the same references in FIG. 7 and will not be described again.

According to this embodiment, the helical stator 28 comprises a rigid helical cylinder 29 and compensators 11 placed between the rigid helical cylinder 29 and the casing 19. In particular, the helical cylinder 29 is not covered with an elastic layer as it is in other embodiments of the invention.

The helical cylinder 29 is made of a metal or a composite material.

Advantageously, the compensators 11 provide the elasticity needed for the dynamic contact between the helical rotor 7 and helical stator 28.

Sizing the compensators 11 according to the above relation (12) leads to a stiffness Ko able to adapt the dynamic properties (particularly the natural frequencies) of the helical system 7-helical stator 28 in order to avoid shocks, resonance, and dynamic instability.

Figure 6:
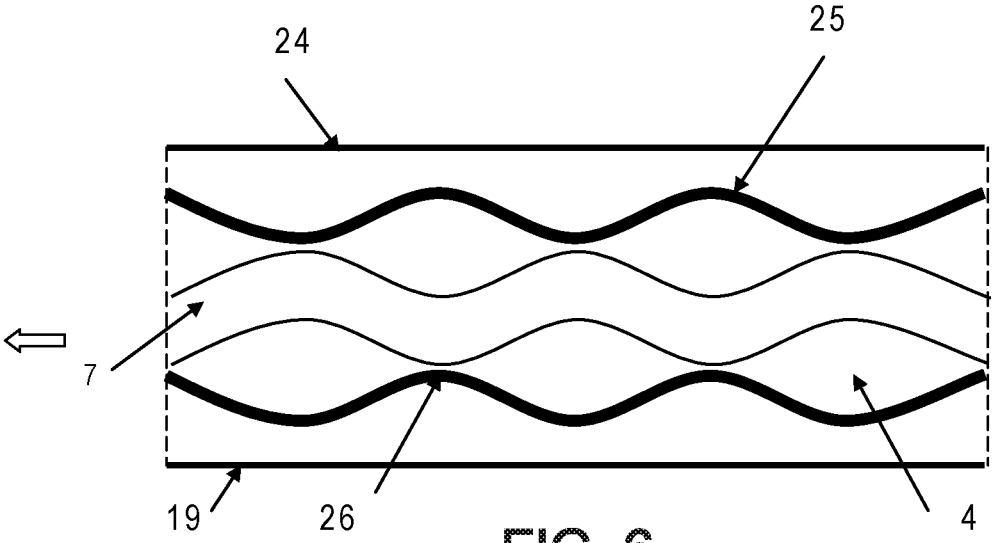
FIG. 6 (PRIOR ART)
FIG. 6 is an axial cross-section of a portion of a PCP having a rigid stator (metal, composite materials) known from the prior art.

For the PCP 24 with rigid stator 25 known in the prior art and illustrated in FIG. 6, if the natural frequency of the paired helical rotor 7-rigid stator 25 is close to the frequency of rotation (speed of 200-500 rpm), the forces due to vibrations and shocks are multiplied by 6-8 and there is an obvious risk of damage to the pump.

The arrangement of the compensators 11 in the helical stator 28 of the PCP 27 illustrated in FIG. 7 significantly alters the natural frequencies of the helical stator 28 and takes away the coupling with the frequency of rotation of the helical rotor 7. Under these conditions, the vibrational forces are reduced. They are divided by 6 to 8 in comparison to the previous case. The vibratory response of the PCP 27 comprising compensators 11 remains within the limits required for optimum operation of the pump.

The compensators 11 provide the necessary elasticity for the dynamic contact (vibrations) between the helical rotor 7 and the helical stator 28, and transmit the forces to the casing 19.

For example, for the PCP 27 having a diameter of 7 cm, the compensators 11 are aluminum and have elliptical profiles with diameters of 1.5 cm and 5, with a thickness of around 2 mm.

According to the embodiments illustrated in FIGS. 1A, 4, 5, and 7, the helical stator 8, 28 comprises a plurality of compensators 11, 18, 21, 23 uniformly distributed all along the casing 19.

According to a variant of the invention (not shown), the helical stator 8 has a single compensator that is helical in shape and is arranged about said helical cylinder 10.

Alternatively, the compensators consist of springs or accordion pleats.

In conclusion, we find that the conventional PCP 1 (with elastomeric stator) combines two functions at the contact between rotor and stator:

- a relative fluidtightness to limit leakage between the cavities,
- concentration of the contact forces and their transfer to the casing.

Thus, as has been explained, the thermodynamic-chemical-dynamic process causes an increase in volume of the stator, which results in excessive forces that can damage the stator.

Statistics show that the service life for these pumps in oil wells is about a year, but damaged stators have been observed after 1-3 months of operation.

The present invention proposes an architecture for a pump comprising a helical stator, which separates these two functions:

- the contact between rotor and elastic layer provides relative fluidtightness between the cavities,
- the increased volume of the elastic layer and the resulting forces are compensated for by the compensators;

the forces are controlled within the required limits and are then transmitted to the casing.

The invention allows reducing the dynamic forces (vibrations, shocks) exerted by the rotor on the elastic layer (elastomer) or on the rigid helical cylinder (metal, composite materials).

Thus, the PCP of the invention comprises compensators capable of decoupling the vibrations from the rotor and the elastic (elastomeric) or rigid (metal, composite materials) elements of the stator, to improve dynamic reliability and performance of PCPs.

EXAMPLE

The conventional PCP 1. A conventional PCP is being used in oil well production; considering the pumping conditions in the well, the initial rotor—stator interference h1=0.5 mm.

Changes in operating conditions leads to increased interference; currently a swelling of the stator of 5% of its thickness is observed, and there is increased interference h1=1 mm.

Accordingly, the new interference and the forces exerted on the elastic stator are twice as large. Given the behavior of the stator, whose elastomer is subject to cyclic stresses (S—N curve), the service life of the stator is divided by two.

With the PCP 6 of the invention, during well production the compensators compensate for swelling of the stator and the initial interference h1=0 5 mm is maintained with no significant change; the forces remain within acceptable limits.

Thus, the PCP 6 comprising a helical stator according to the invention has a service life of twice that of the conventional PCP 1; this is a significant technical and economic advantage.

REFERENCES

1. Patent EP0220318 A1 discloses a progressive cavity motor for oil drilling. Drilling mud is the driving fluid. To achieve this, the drill bit is installed after the motor, said bit transmitting to the motor strong longitudinal vibrations that can damage the elastomeric stator. These strong longitudinal vibrations are due to the stresses as the drill bit penetrates the rock.

To reduce the effect of longitudinal vibrations, this patent provides a "shock absorber" system (Energieabsorber 10, FIG. 1 of the patent).

Similar to a fluid bearing, the "shock absorber" dissipates the energy of longitudinal vibrations through a hydraulic maze. Indeed, the viscous friction of the flow of liquid within the hydraulic maze dampens the longitudinal vibrations by dissipating energy; is an absorber that dissipates energy by hydraulic friction (FIGS. 3,4,5 of the patent).

The chemical composition of the drilling mud does not produce swelling of the stator elastomer. Therefore, the swelling problem for the stator of PCPs used for pumping oil does not arise in the case of the downhole motor.

Also, the liquid of the shock absorber (hydraulic maze) is incompressible; this device can not compensate for transverse swelling of the elastic stator or for transverse vibrations.

The PCP that is the object of the invention comprises compensators (FIGS. 1A and 1B) that can compensate, by their elasticity, for transverse deformations of the stator. Indeed, stator swelling is due to operating conditions of the pump downhole during oil production: damaging liquids and gases, high temperatures and pressures.

Thus, we find that the operating conditions of the downhole motor have nothing in common with the pumping of oil.

The compensators are elastic elements made of metal or composite materials, deforming to compensate for variations in the volume of the stator (swelling of the elastic layer) and for transverse vibrations of the rotor.

They therefore have nothing of the hydraulic maze (hydraulic shock absorber) whose role is to dissipate the energy of longitudinal vibrations from drilling into the rock.

The architecture and operation of the PCP comprising a helical stator with compensators are very different from the downhole motor comprising a hydraulic shock absorber system as proposed by that patent.

2. US Patent 2006/0153724 A1 discloses a drilling motor comprising a progressive cavity stator consisting of two layers of elastomer having different mechanical properties.

As mentioned above, when pumping in an oil well, the thermodynamic-chemical-dynamic effect causes deformation of the stator elastomer (swelling). Oil drilling is quite different; the liquid of the drill motor consists of pressurized drilling mud injected from the surface.

The operating conditions of pumping in an oil well are very different from those when drilling.

The patent describes a stator comprising two elastomer layers. Under these conditions, the thermodynamic-chemical-dynamic effect of pumping oil generates differential distortions of the elastomeric stator.

The risk of the rotor causing damage to the two-layered elastomeric stator remains.

Therefore, the use of the two-layered elastomeric stator when pumping oil results in reduced reliability and service life.

The architecture and operation of the PCP comprising a helical stator with compensators are very different from the drill motor comprising a stator with two elastomer layers proposed by that patent.

Figure 8:
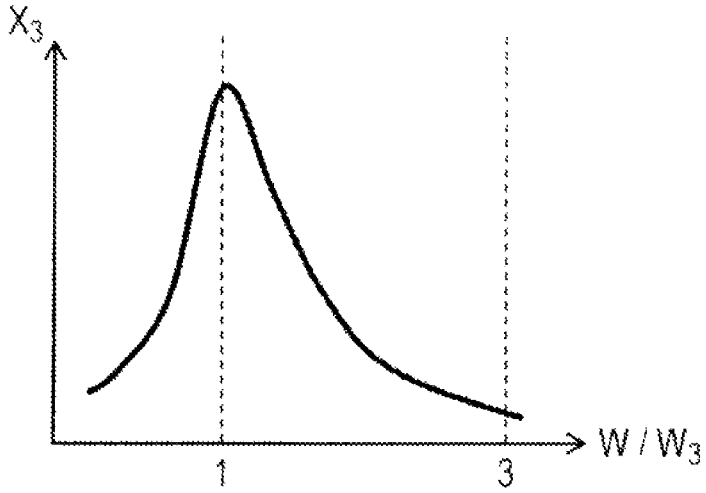
FIG. 8 is a graph with the x-axis representing the ratio between the frequency of rotation W of the helical rotor 7 and the frequency of vibration $W_3$ of the assembly of helical rotor 7 and helical stator 8, and the y-axis representing the amplitude of the vibrations $X_3$ in a direction perpendicular to the central axis Y-Y of the helical stator 8.

FIG. 8 is a graph where the x-axis represents the ratio between the frequency of rotation W of the helical rotor 7 and the frequency of vibration $W_3$ of the helical rotor 7 and helical stator 8 assembly, and the y-axis represents the amplitude of vibrations $X_3$ in a direction perpendicular to the central axis Y-Y of the helical stator 8. When the helical rotor 7 rotates, it causes vibration of the helical cylinder 10 in a plane passing through the central axis Y-Y, the movement being a combination of a straight path with a rotation.

When the frequency of vibration $W_3$ of the helical rotor 7 and helical stator 8 assembly is equal to the frequency of rotation W of the helical rotor 7, the helical stator 8 and helical rotor 7 assembly vibrate in resonance. This leads to rapid deterioration of the pump.

The graph in FIG. 8, obtained by analyzing a pump according to the invention, reveals that when the ratio between the frequency of rotation W of the helical rotor 7 and the frequency of vibration $W_3$ of the helical rotor 7 and helical stator 8 assembly is greater than 3, the frequency of rotation of the helical rotor 7 is decoupled from that of the helical cylinder 10.

Thus, to have the helical stator 8 no longer vibrating in resonance with the rotation of the helical rotor 7, it is desirable that the ratio between the frequency of rotation W of the helical rotor 7 and the frequency of vibration $W_3$ of the helical rotor 7 and helical stator 8 assembly be greater than 3.

$$\text{In other words, } \frac{W}{W_3} \geq 3 \tag{13}$$

$$\text{Therefore } \frac{W^2}{W_3^2} \geq 9 \tag{14}$$

Moreover, it is known that the stiffness Ko of a compensator is equal to the sum M of the total mass of the helical rotor 7 and helical stator 8 assembly, multiplied by the square of the frequency of vibration $W_3$ of the helical rotor 7 and helical stator 8 assembly.

$$Ko = M.W_3^2 \tag{15}$$

By combining relations (14) and (15), we obtain the following relation:

$$Ko \leq (1/9).M.W^2 \tag{12}$$

where:

W is the frequency of rotation of the helical rotor 7,

M is the total mass of the helical rotor 7 and helical stator 8.

Thus, the choice of stiffness Ko of the compensators 11 allows decoupling the natural frequencies of the helical rotor 7 and helical stator 8 assembly from the frequency of rotation of the helical rotor 7.

The helical cylinder 10 is rigid in all the embodiments described.

Advantageously, it is possible to arrange compensators all along the pump according to a distribution determined based on the deformation of the helical rotor 7 along the pump (natural vibration modes).

Said deformable compensators are elastic structures made of metal or composite materials, whose mechanical properties (elasticity, hysteresis) and high resistance to cyclic fatigue stresses (Wohler curve) ensure good pump reliability.

The distribution of said deformable compensators along the pump can be: continuous or discontinuous, uniform or non-uniform, of constant or variable density, of constant or variable stiffness. Indeed, during vibrations, the helical rotor-helical stator assembly is deformed all along the pump; for example, the deflection is greater at the ends. To compensate for deformations of the ends, the distribution of the compensators is adjusted, for example with a greater density near the ends of the pump.

Under these conditions, the movement of the helical rotor-helical stator assembly is as one unit, thereby eliminating the risk of shocks, phase differences, and instabilities between the helical rotor and the helical stator. FIG. 8 shows the vibrational behavior of the PCP with compensators 11; the vibrations $X_3$ of the rotor-stator assembly have frequency $W_3$ and the rotation of the rotor occurs at frequency W.

As a result, it is sufficient to design the stiffness Ko of the compensators 11 so as to significantly reduce vibrations of the PCP pump (FIG. 8).

The deformable compensators 11 perform several functions:

- compensating for movements (vibrations) of the rotor-stator assembly;
- compensating for deformation of the rotor-stator assembly along the pump;
- controlling vibrations of the PCP pump and thus ensuring improved reliability and increased hydraulic performance.

As shown in FIG. 8, the stiffness Ko is the design criterion for the deformable compensators 11. The stiffness Ko determines the dimensions, shape (geometry), and materials (elasticity and resistance to cyclic stresses).

Indeed, with the stiffness Ko, the compensators 11 provide a strong reduction in vibrational forces on the rotor-stator assembly and significantly improve pump reliability.

The materials of the compensators are metal (steel, aluminum) and composite materials. The compensators are elastic structures that deform to compensate for movements (vibration) of the rotor-stator assembly. The mechanical properties of the required materials are: elasticity (linear and hysteresis) and the ability to withstand a large number of cyclic fatigue stresses (Wohler curve).

Metal materials (steel, aluminum) have these properties. In composite materials, there is a wide variety of high-strength structures with good behavior when subjected to cyclic stresses (Wohler curve).

The invention claimed is:

1. A progressive cavity pump comprising:

a cylindrical casing having a longitudinal axis, said casing being provided with an inlet opening at one end and with an outlet opening at its opposite end, a helical stator contained within said casing, said helical stator comprising a helical cylinder having a central axis coinciding with the longitudinal axis of said casing;

a helical rotor suitable for rotating inside said helical cylinder so as to move a fluid from the inlet opening toward the outlet opening, wherein said helical stator further comprises at least one compensator arranged within said casing, between the casing and said helical cylinder, said helical cylinder and said compensator being adapted to deform in a direction perpendicular to said longitudinal axis, and wherein the helical rotor is adapted to rotate at a frequency of rotation, and wherein said at least one compensator decouples the natural frequencies of the helical rotor and helical stator assembly from the frequency of rotation of the helical rotor; said at least one compensator being defined by a coefficient of stiffness which satisfies the following relation:

$$Ko \leq (1/9).M.W^2$$

where:

W is the frequency of rotation of the helical rotor,

M is the total mass of the helical rotor and helical stator.

2. The progressive cavity pump according to claim 1, wherein said at least one compensator has a closed profile.

3. The progressive cavity pump according to claim 1, wherein said at least one compensator has an elliptical cross-section.

4. The progressive cavity pump according to claim 1, wherein said at least one compensator has an open profile.

5. The progressive cavity pump according to claim 1, wherein said at least one compensator is arranged on a concave portion of said helical cylinder.

6. The progressive cavity pump according to claim 1, wherein said at least one compensator is arranged on a convex portion of said helical cylinder.

7. The progressive cavity pump according to claim 1, wherein said helical stator comprises a plurality of compensators evenly distributed along the casing.

8. The progressive cavity pump according to claim 1, wherein said helical stator comprises a single compensator that is helical in shape, arranged around said helical cylinder.

9. The progressive cavity pump according to claim 1, wherein said at least one compensator is made of a metal or a composite material.

10. The progressive cavity pump according to claim 1, wherein said helical stator comprises an elastic layer fixed to an inner face of said helical cylinder.

11. The progressive cavity pump according to claim 10, wherein said elastic layer has a thickness of between 0.5 centimeters and 2 centimeters.

12. Application of the progressive cavity pump as claimed in claim 1, for pumping fluids, said fluids being liquids, viscous liquids, or gases, and for pumping multiphase mixtures of liquids and gases with solid particles.

13. The progressive cavity pump of claim 10 wherein said elastic layer has a thickness of between 0.5 to 1.5 centimeters.

* * * * *